US005622388A

United States Patent [19]

Alcordo

[11] Patent Number: 5,622,388

[45] **Date of Patent: *Apr. 22, 1997**

[54] POSTCARD RANK CHECK

[76] Inventor: Isabelo S. Alcordo, 613 E. Summit St., Wachula, Fla. 33873

[ * ] Notice: The term of this patent shall not extend beyond the expiration date of Pat. No. 5,566,981.

[21] Appl. No.: 500,051

[22] Filed: Jul. 10, 1995

Related U.S. Application Data

[63] Continuation-in-part of Ser. No. 409,159, Mar. 23, 1995, abandoned.

[51] Int. Cl.[6] ..... B42D 15/00

[52] U.S. Cl. ..... 283/58; 283/57; 229/92.8

[58] Field of Search ..... 283/57–59; 229/92.1, 229/92.8, 72, 92

[56] References Cited

U.S. PATENT DOCUMENTS 2,374,723 5/1945 Barghausen ..... 283/58 X 3,950,013 4/1976 Tagliaferri ..... 283/58 X

FOREIGN PATENT DOCUMENTS 8200844 10/1983 Netherlands ..... 283/58

*Primary Examiner*—Frances Han

*Attorney, Agent, or Firm*—Frank A. Lukasik

[57] ABSTRACT

The invention is a bankable apparatus or post card bank check for sending payments or contributions by mail without the use of any letter envelope. The post card bank check may be used for personal check payments or it may carry with it the dollar value of the instrument of such denominations as the issuing banks may determine and as the buyer may choose for the purpose of sending money from the sender to the recipient. A security strip is provided for use when the payor wishes to conceal the account number. The postcard check may be negotiable as any other personal check or it may be non-negotiable and withdrawable only with the use of the recipient's own bank check making it a safe way to transfer money from a donor to a recipiient

2 Claims, 12 Drawing Sheets

POSTCARD RANK CHECK

RELATED PATENT APPLICATION

This is a continuation-in-part of patent application Ser. No. 08/409,159, filed Mar. 23, 1995, now abandoned the disclosures of which are incorporated by reference.

BACKGROUND OF THE INVENTION

1. Field of the Invention

This invention relates to a bankable apparatus or item for sending any reasonable amount of money by mail for any purpose.

2. Discussion of the Prior Art

Tens of millions of checks are being sent by mail daily in the United States and in all the countries of the world. A very large portion of these checks have face values in relatively small amounts to be of any serious concern if the printed or written face values were not concealed but exposed to mail carriers or to other persons involved in the transaction, as it would be in the case of post card checks. Senders or writers of post card checks, however, are apprehensive about exposing to the public their personal, company, or corporate bank account numbers for fear of their being duplicated by the criminal elements in society in order to produce fraudulent checks to raid their bank accounts. Thus, despite some advantages of using post card checks, their use by individuals as personal checks is almost non-existent, while business entities use them only for extremely small amounts. There is, therefore, a need to produce a postcard-check type that conceals from the public the bank account numbers of the senders, writers, or payors.

The advantages of using postcard checks that one can just drop into the mailbox without placing them inside envelopes are both financial and personal. In the United States, the postage for internal, local, or national first class mails in envelopes is $0.32. For postcards, the postage is $0.20. Using postcard checks instead of the regular checks that need to be placed inside envelopes would mean a savings of $0.12 per check mailed. There is also the cost of the envelope to consider.

The most distasteful thing in using envelopes for mailing, is the licking of these envelopes. Applicant, who sends many checks for charities every pay period or every other week, would salivate to the point of vomiting every time he licks these envelopes. The use of postcard checks to send small amounts to charities that solicit by mail will save him from all of these lickings. In licking envelopes, there is also the real danger of cutting one's tongue. All of these, no doubt, discourage people from giving to charities that solicit by mail.

For one receiving 10 to 20 solicitations per month a donation of $1.00, $2.00, $5.00, $10.00, or $20.00 per donation would cost a minimum of $10.00 to a maximum of $400.00 dollars per month. To one with a generous heart, but a very limited means such a person goes through a lot of mental anguish each month as he/she tries to determine who gets his/her donation and how much.

(2) After the decision is made as to how many charities and how much each gets his/her donation for the month he/she then goes through much hassle. He/she must (a) write the name of the charity/church on a personal check, (b) sign the check, (c) place the check inside an envelope, (d) lick the envelope, (e) close the envelope, (f) buy a postage stamp, (g) lick the stamp, and (h) stick the stamp on the envelope.

The above are not small matters when one is giving to as many as 10 to 20 charities/churches each month. The postage stamps alone would cost from $2.90 to $5.80 each month. There is also the cost of using 10 to 20 personal checks and the headache of reconciling the checking accounts, what with so many checks being issued each month. They are irritating and they discourage giving. These problems are real not only to the proponent of the instant invention but also to tens of millions of kind-hearted charity donors in the U.S. and in all of the advanced countries in the world.

The instant invention of a directly mailable postcard-type check, personal or otherwise, significantly minimizes these problems. Also, a reduction in postage for checks mailed in envelopes from $0.32 to $0.20 for postcards means a savings to the donor of $0.10 per mailed donation.

SUMMARY OF THE INVENTION

Accordingly, it is an object of the invention to provide a directly and immediately mailable postcard-type bankable apparatus or item, in the form of a bank check—personal or otherwise—for the purpose of sending money by mail.

It is another object of the invention to provide a secured postcard check stock (SPcCS) for use in printing secured postcard bank checks.

It is also a further object of the invention to provide at least three types of secured bank checks, namely: negotiable postcard checks (N-SPcC); Non-negotiable postcard checks (NN-SPcC); and non-negotiable money-order-type (with a printed, fixed amount) postcard checks (NN-mo SPcC) whereby the magnetic-ink characters for the bank account numbers are as effectively concealed, as when checks are mailed inside envelopes, by a security strip (SS) invention.

In carrying out the purpose of the invention in the illustrative embodiment thereof, a paper material of such thickness and quality acceptable to the Postmaster General of the United States for the granting of a FIRST CLASS MAIL PERMIT will be used. The shape and dimensions of the postcard bankcheck of the invention may be that of a personal bank check, that of a small letter envelope or that of a regular picture postcard.

Upon the granting of a FIRST CLASS MAIL PERMIT, the statement "NO POSTAGE NECESSARY IF MAILED IN THE UNITED STATES" is printed on the right hand upper corner of the address side of each postcard bank check, meeting all of the requirements of law as to the registration of the numerical volume being printed. Also on the address side, is the name and address of the charity for the purpose of mailing and for crediting the amount to the account of the charity thus named. At the left hand upper corner of the postcard bank check is the name and address of the donor or sender.

On the other side of the postcard bank check, that is, the back of the address side, is the face of the bank check on which the following information is found: the dollar value of the item or apparatus or check in figures and in words, the name and address of the issuing bank, such security codes and check series numbers that the bank may require the printer of the postcard bank check to include, and the statement "FOR DEPOSIT ONLY" below the amount on the face of the postcard bank check. The recipient charity can withdraw the amount only with the use of its own checks. The postcard bank checks may be issued in booklets of 10 to 20 checks consisting of one denomination or a combination of various denominations such as $0.50, $1.00, $2.00, $5.00 for total booklet values of from $5.00 to $100.00.

DESCRIPTION OF THE PREFERRED EMBODIMENT

Figure 1:
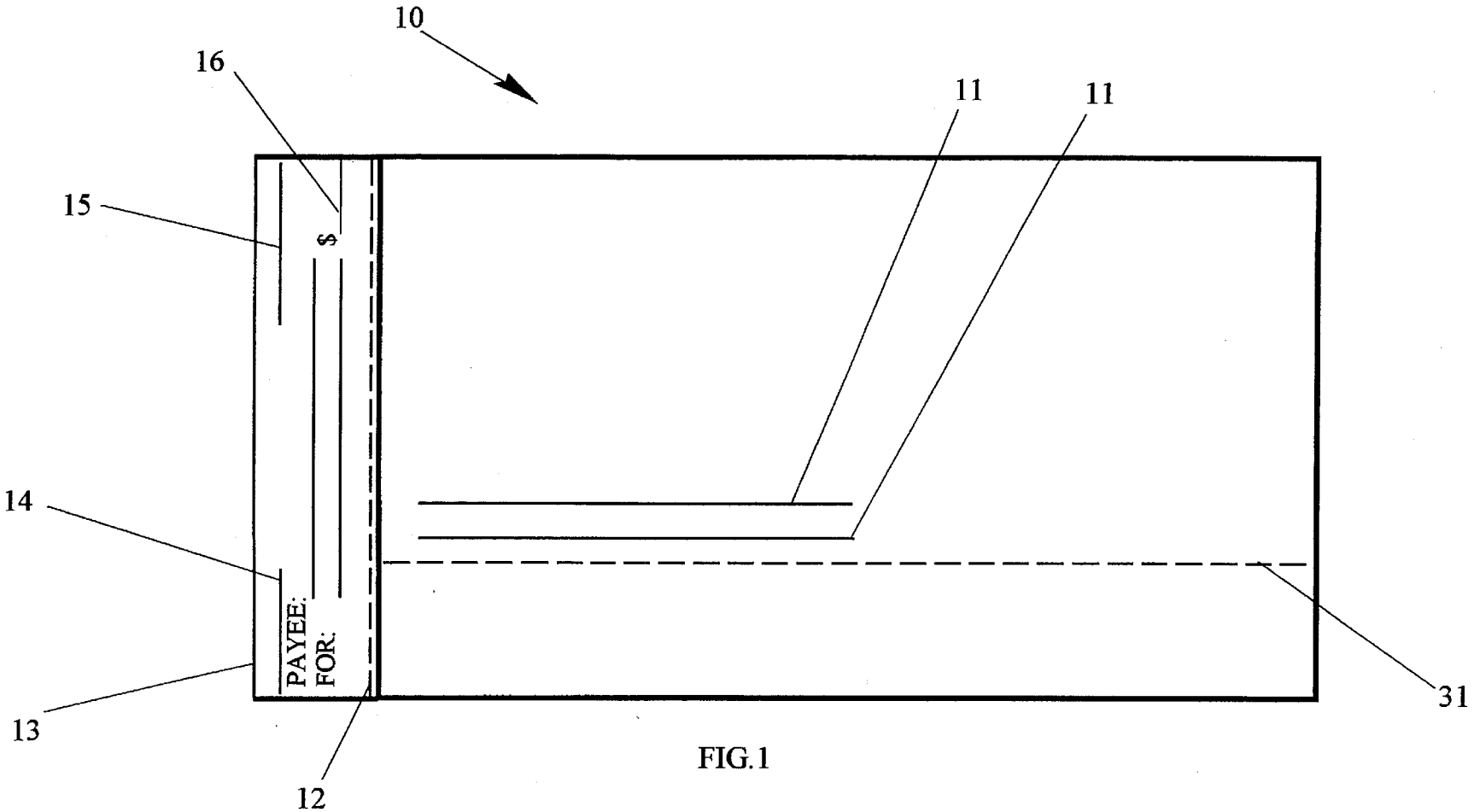
FIG. 1 is a top plan view of a card stock with perforations for removal of stubs and slits for security purposes.
Figure 2:
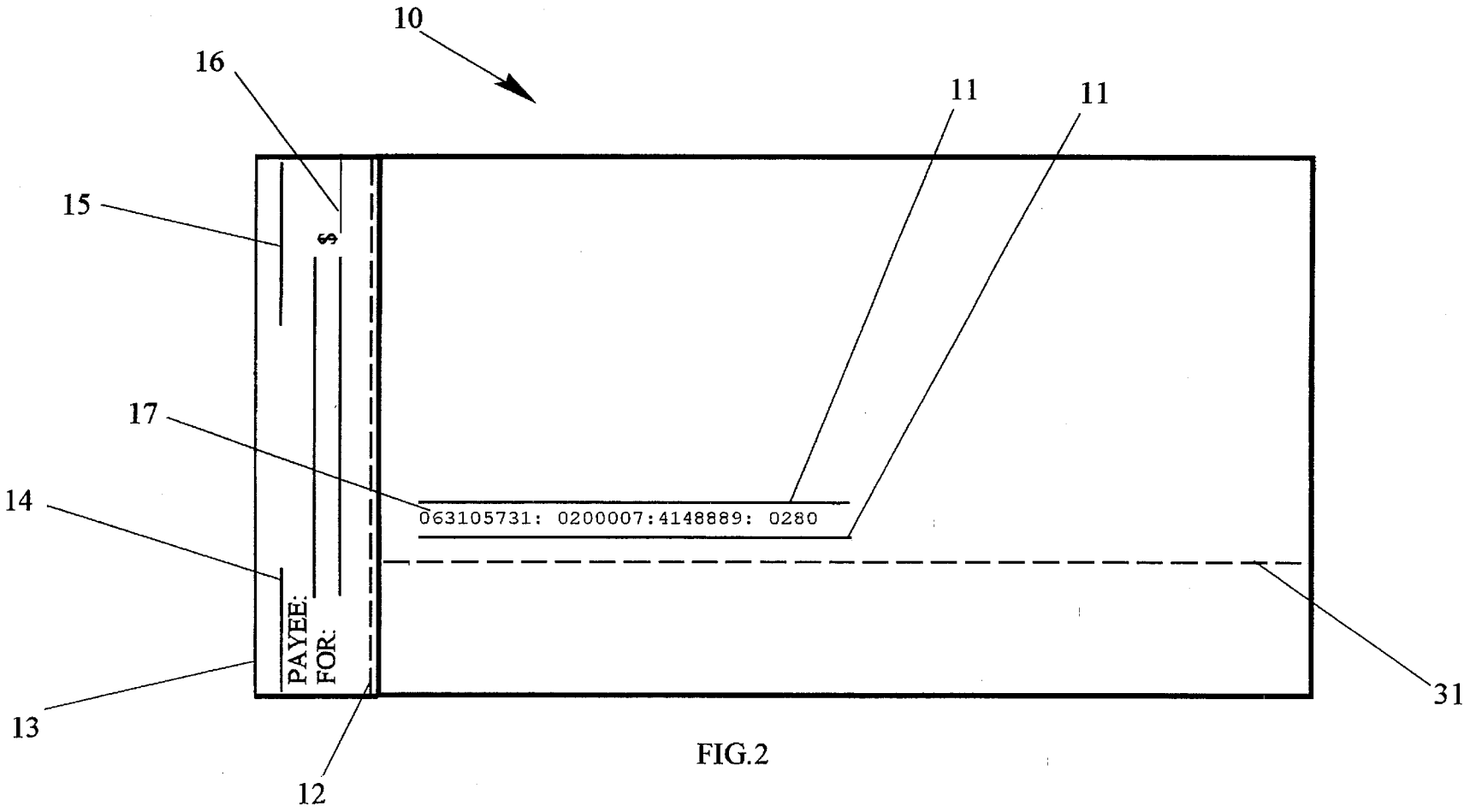
FIG. 2 is a top plan view of the face side of a post card check in accordance with the invention.

Referring to FIG. 1 there is shown the card stock for the post card check designated by the numeral 10 and showing the slits 11, perforation 12 and perforation 31. FIG. 2 is the face side of post card check 10 when first printed with check stub 13 information and the magnetic ink imprinting 17, and may be a flat, rectangular item, made of any suitable material, and decorated in any manner, and may be of any suitable size and dimension, but preferably that of a small mailing envelope or that of a regular picture postcard. The shape and dimensions of the postcard check 10 will be those that meet the requirements of the USPS for ordinary postcards presently requiring a postage of $0.20. The postage may be a regular stamp or one directly printed on the back of the postcard checks under a USPS permit.

The secured postcard check stock (SPcCS) of the invention will have two slits 11 located just on top and just below the space allotted for printing of the magnetic ink character encoding strip 17 (MIC-ES) for the printing of the "transit number field", and the "on us field" as specified by the American National Standard for check printing. The slits 11 may extend from the "transit number field" up to the length of the "on us field" or they may be limited only to the "on us field" which is the field for the check writer or the payor's bank account number.

On a first side of the secured postcard check stock is printed the desired type of checks (negotiable or non-negotiable or money-order type) with the magnetic ink codes 17 printed right between the two slits 11. At the second side of the checks are the corresponding sender/payee and other relevant information.

Figure 4:
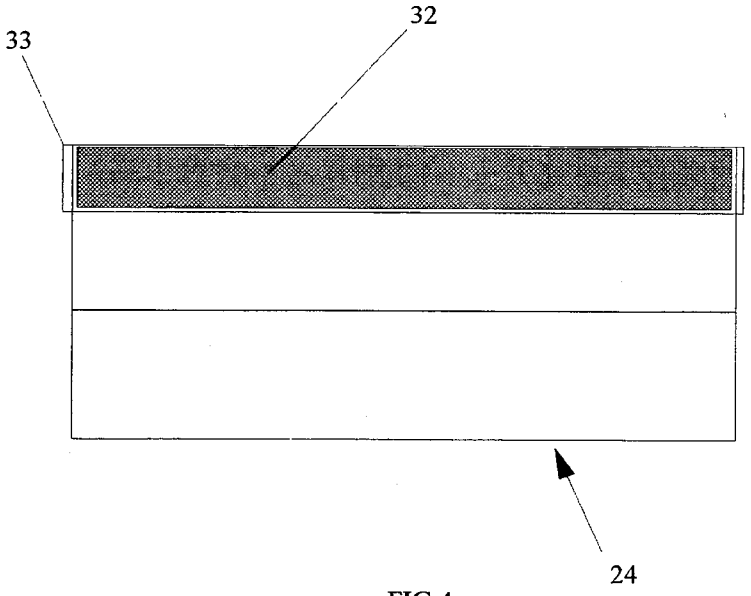
FIG. 4 is a bottom plan view of a security strip in accordance with the invention.
Figure 3:
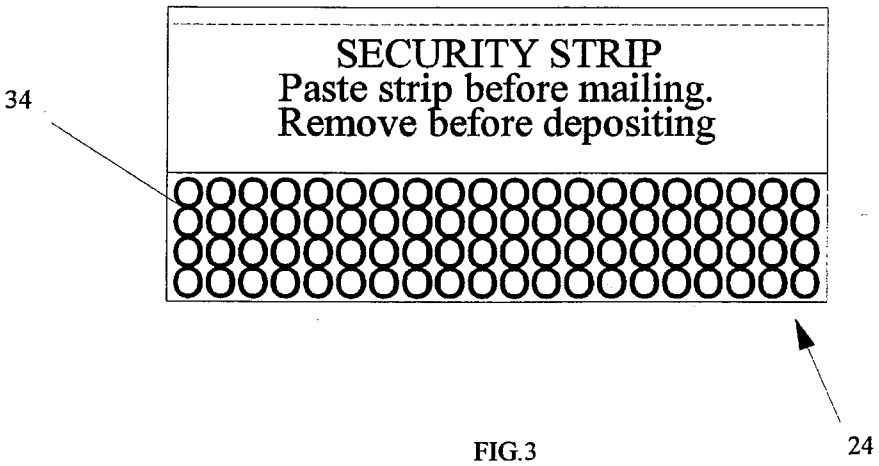
FIG. 3 is a top plan view of a security strip in accordance with the invention.

Referring to FIGS. 3 and 4, there is shown the security strip 24 which may be used to conceal the payee's account numbers included in magnetic ink imprinting 17 when desired. The security strip 24 may be made from various paper materials the length of which is just a little less than the length of the slits 11 in the secured postcard check stock to allow it to be inserted easily into the slits 11. The width of the security strip 24 is such as to facilitate pasting the strip securely onto the postcard check. Markings 34 are printed on the security strip 24 space that fits over the MIC encoding strip 17 to help conceal the bank account numbers. Also printed are instructions: "Paste Strip Before Mailing" and "Remove Strip Before Depositing" and as well as the words "SECURITY STRIP" to identify the use or purpose of the invention. A strip of self adhesive 32 is applied on the adhesive region 32 and a release liner 33 is placed over the adhesive region 32 to protect it prior to its use. The release liner 33 may be coated with wax or silicone or any state of the art means.

Figure 7:
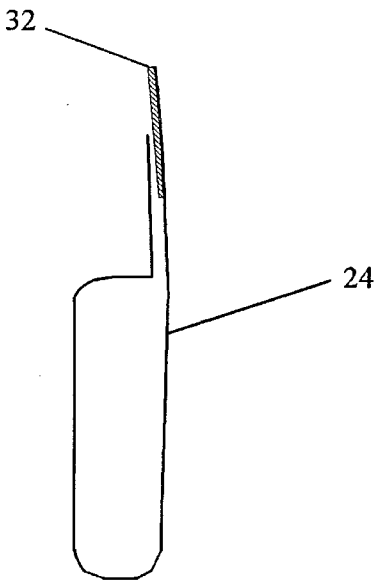
FIG. 7 is an exploded side view of the security strip showing the relationship of the adhesive strip.
Figure 6:
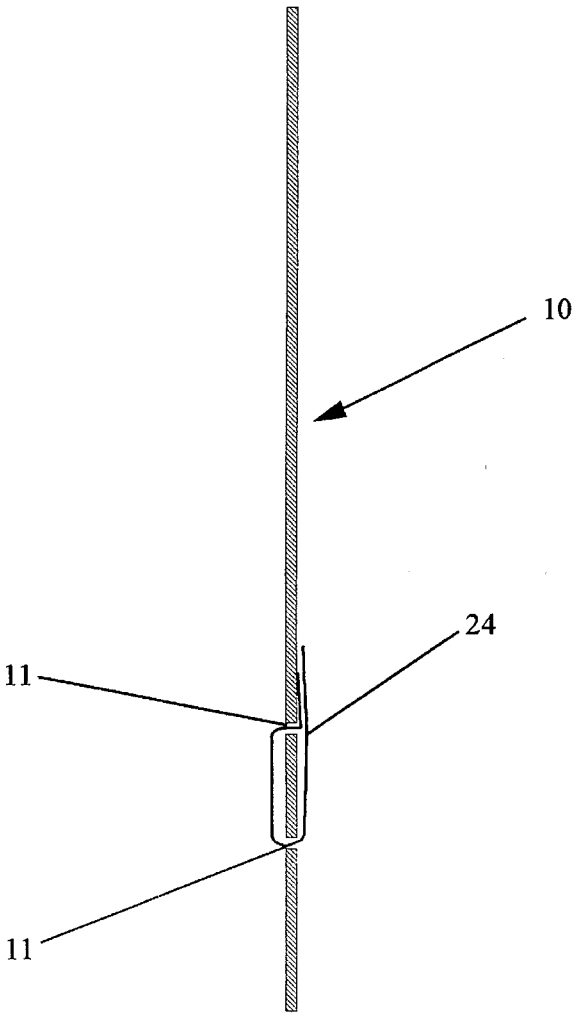
FIG. 6 is a side view, partially in section, of the security strip of the invention just before it is sealed to the card stock.
Figure 5:
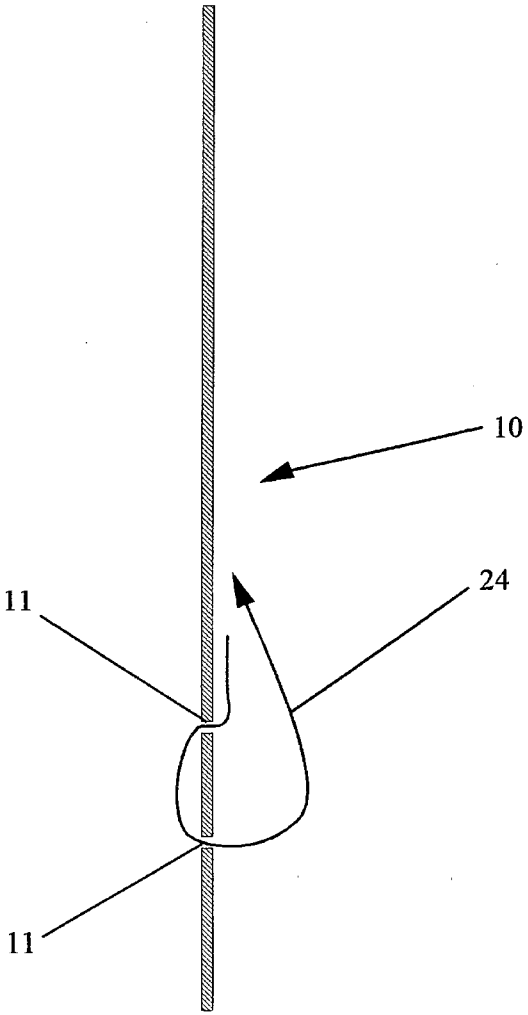
FIG. 5 is a side view, partially in section of the security strip of the invention inserted in slits in the card stock.
Figure 8:
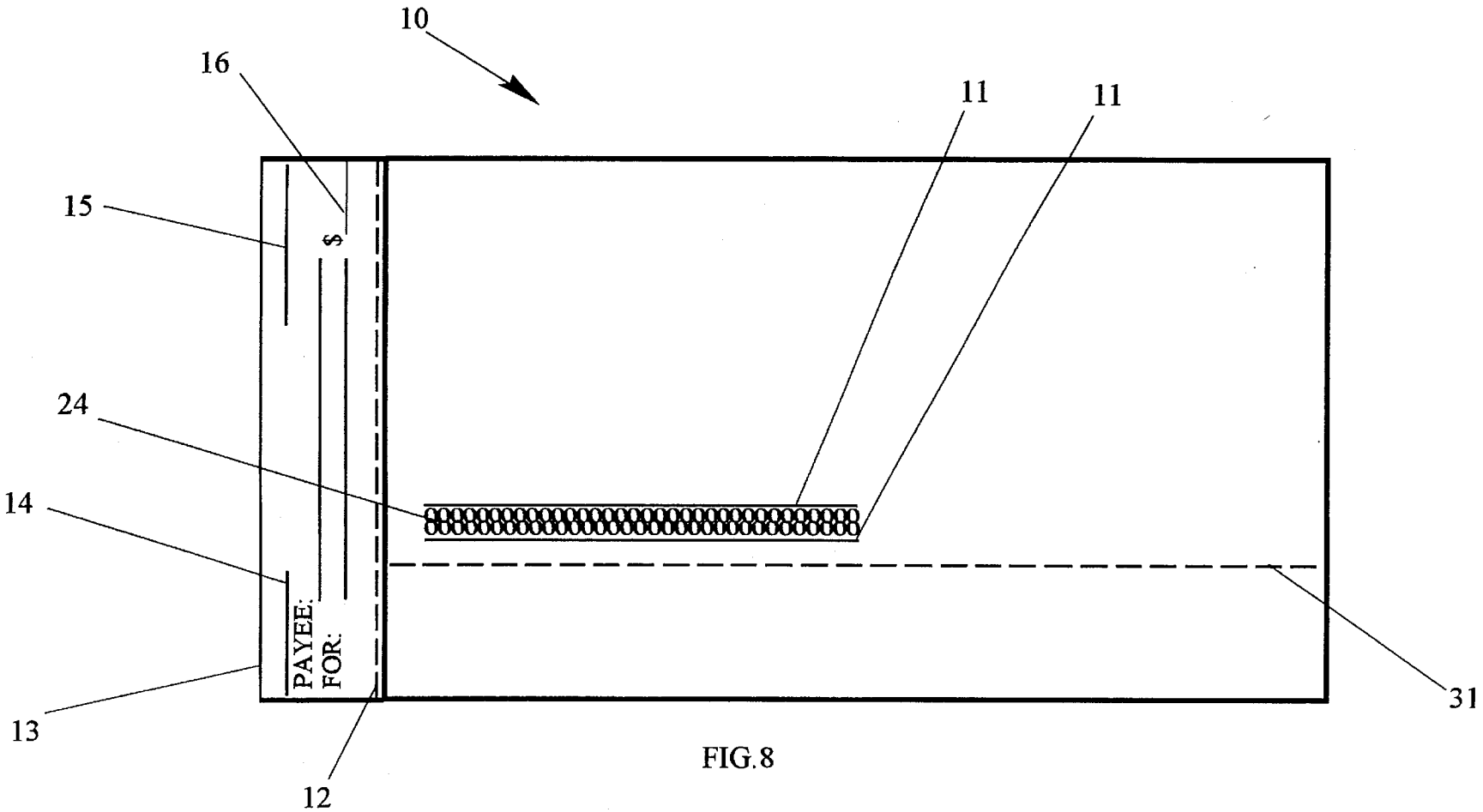
FIG. 8 is a top plan view of the face side of a post card check with a security overlay in place.
Figure 9:
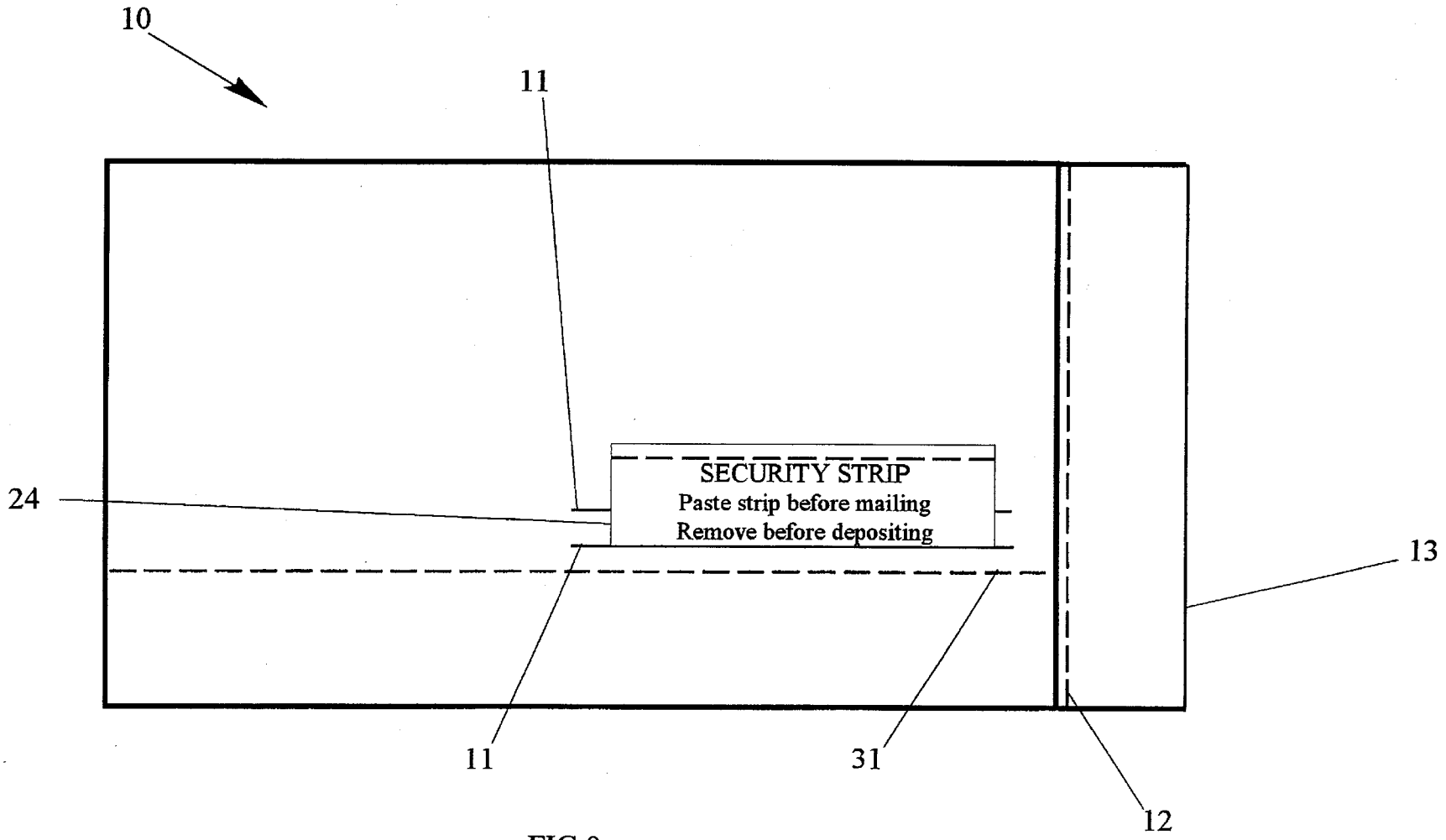
FIG. 9 is a reverse side of a post card check showing a security strip in place.
Figure 10:
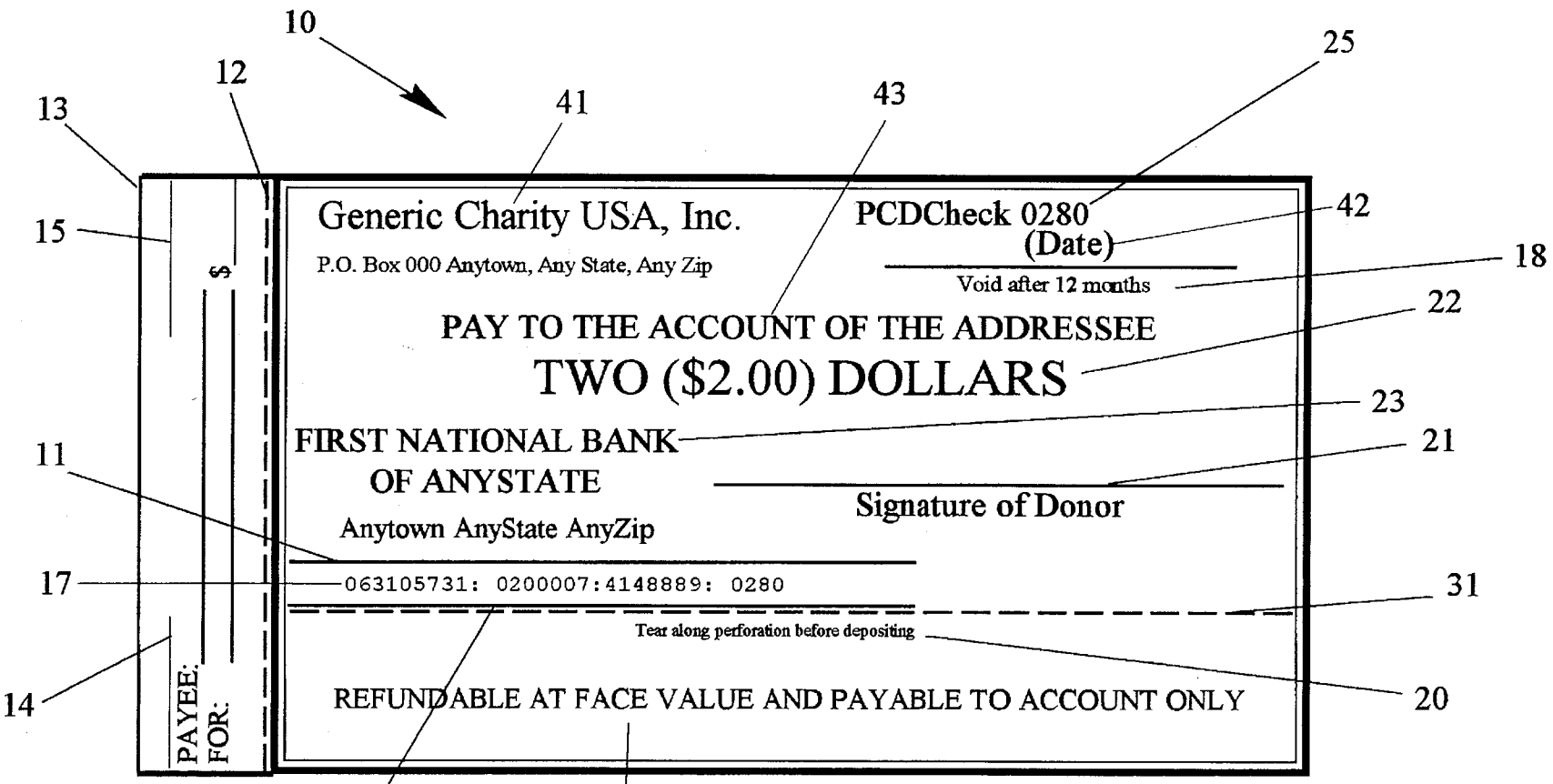
FIG. 10 is a top plan view of a non-negotiable money-order-type postcard check in accordance with the invention.
Figure 11:
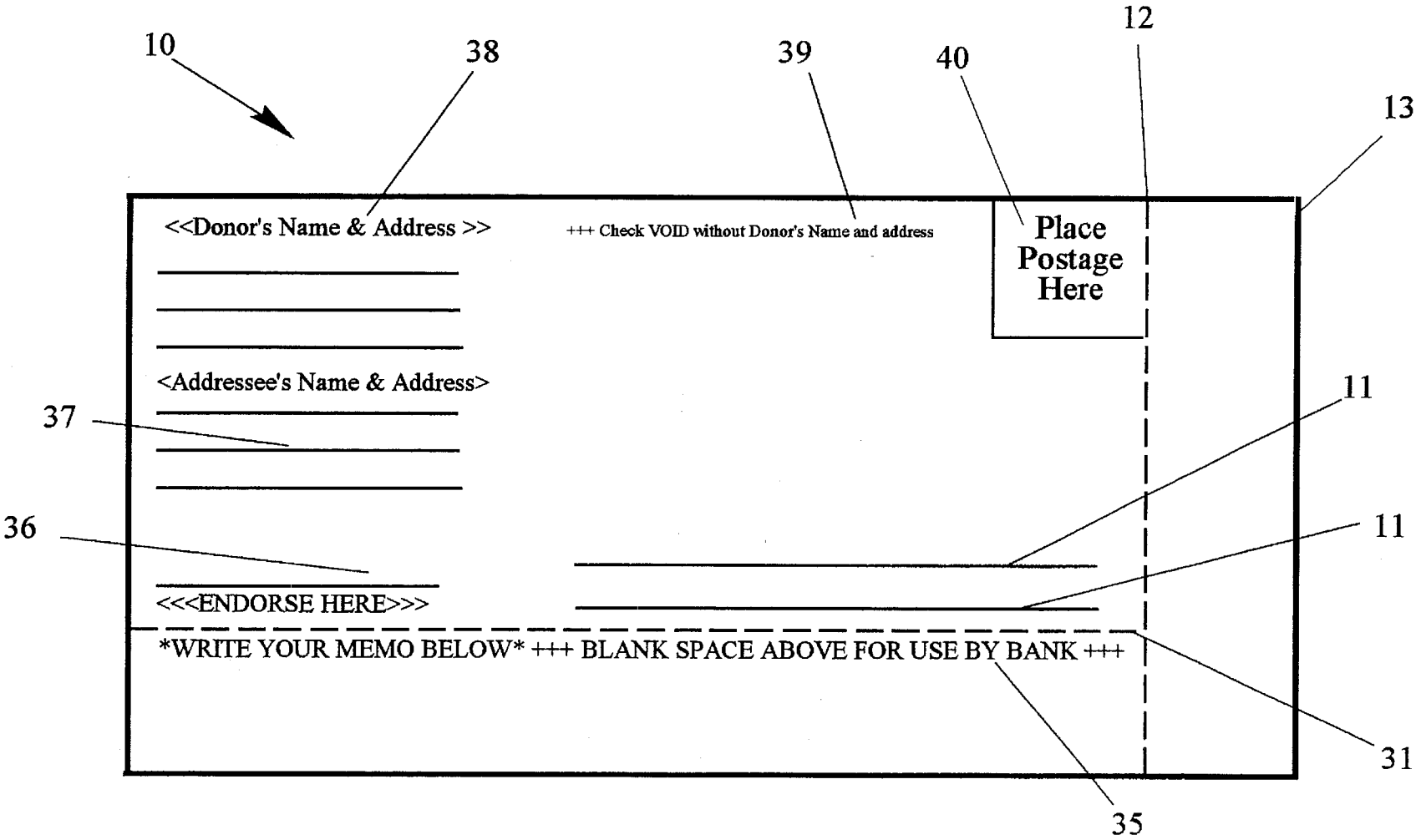
FIG. 11 is a bottom plan view of a non-negotiable money-order-type postcard check in accordance with the invention.
Figure 12:
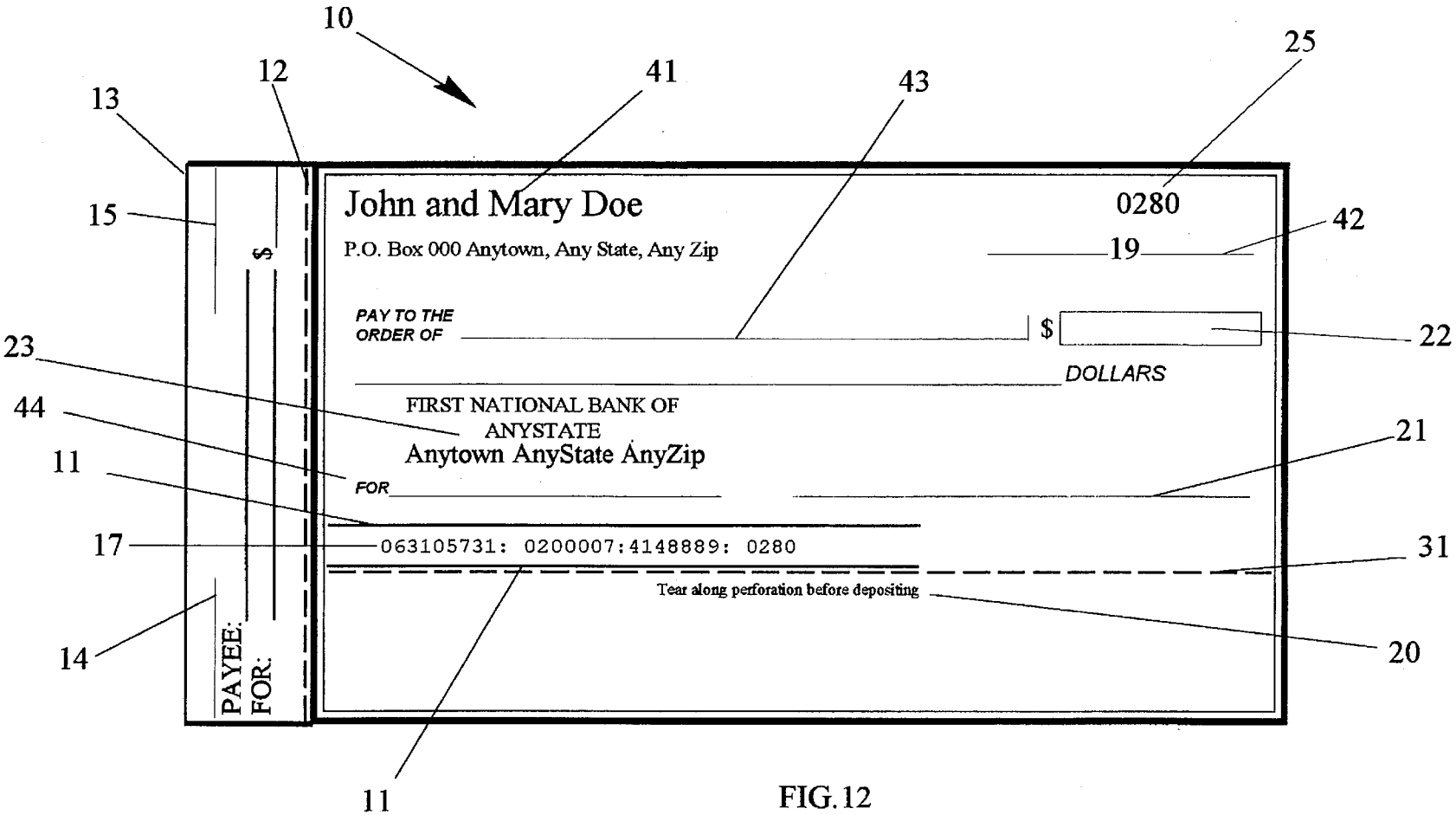
FIG. 12 is a top plan view of a negotiable postcard check with the magnetic ink printing visible between the slits and before a safety strip is applied.
Figure 13:
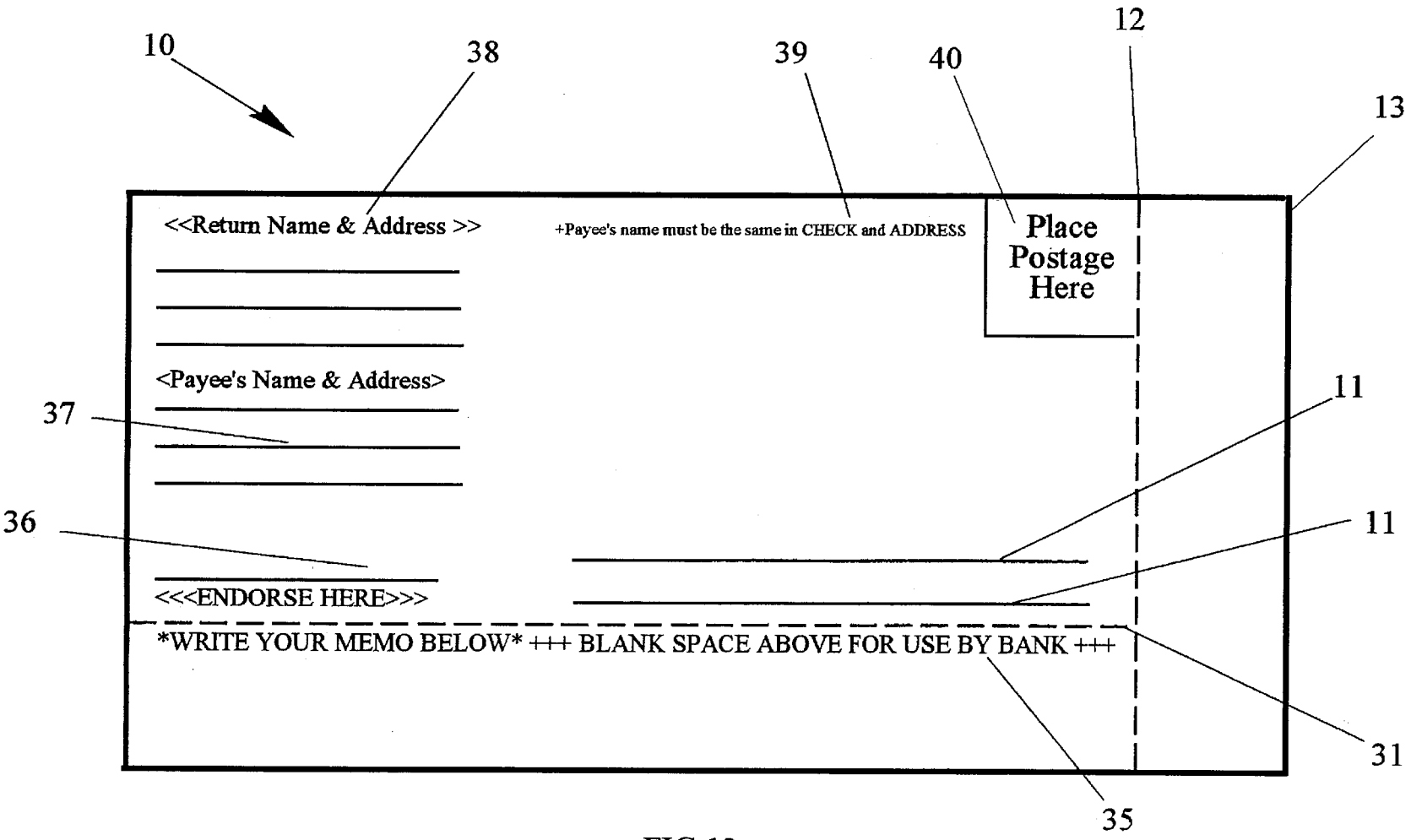
FIG. 13 is a bottom plan view of a negotiable postcard check before a safety strip is applied.
Figure 14:
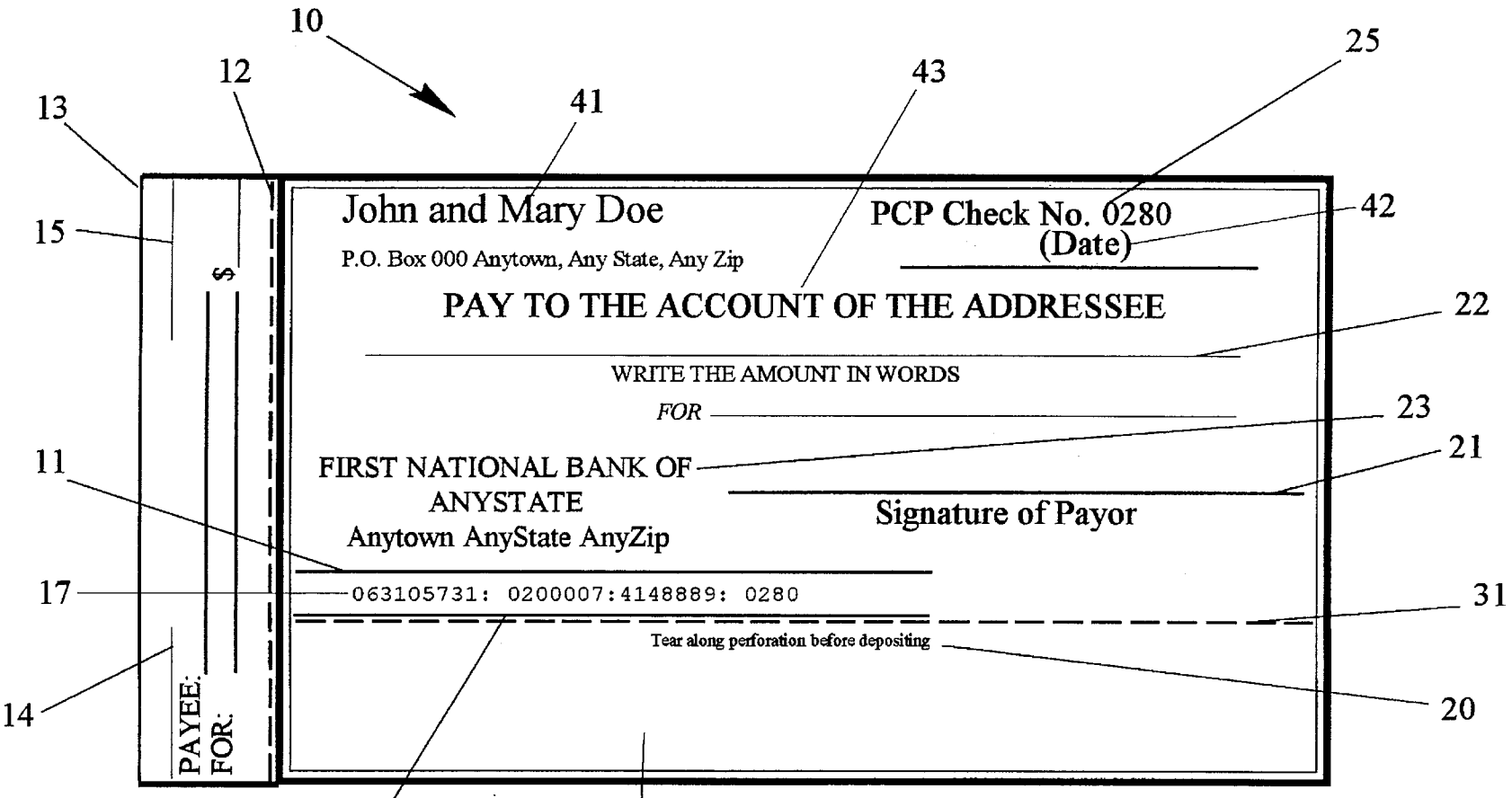
FIG. 14 ia a top plan view of a non-negotiable postcard check before a safety strip is applied.
Figure 15:
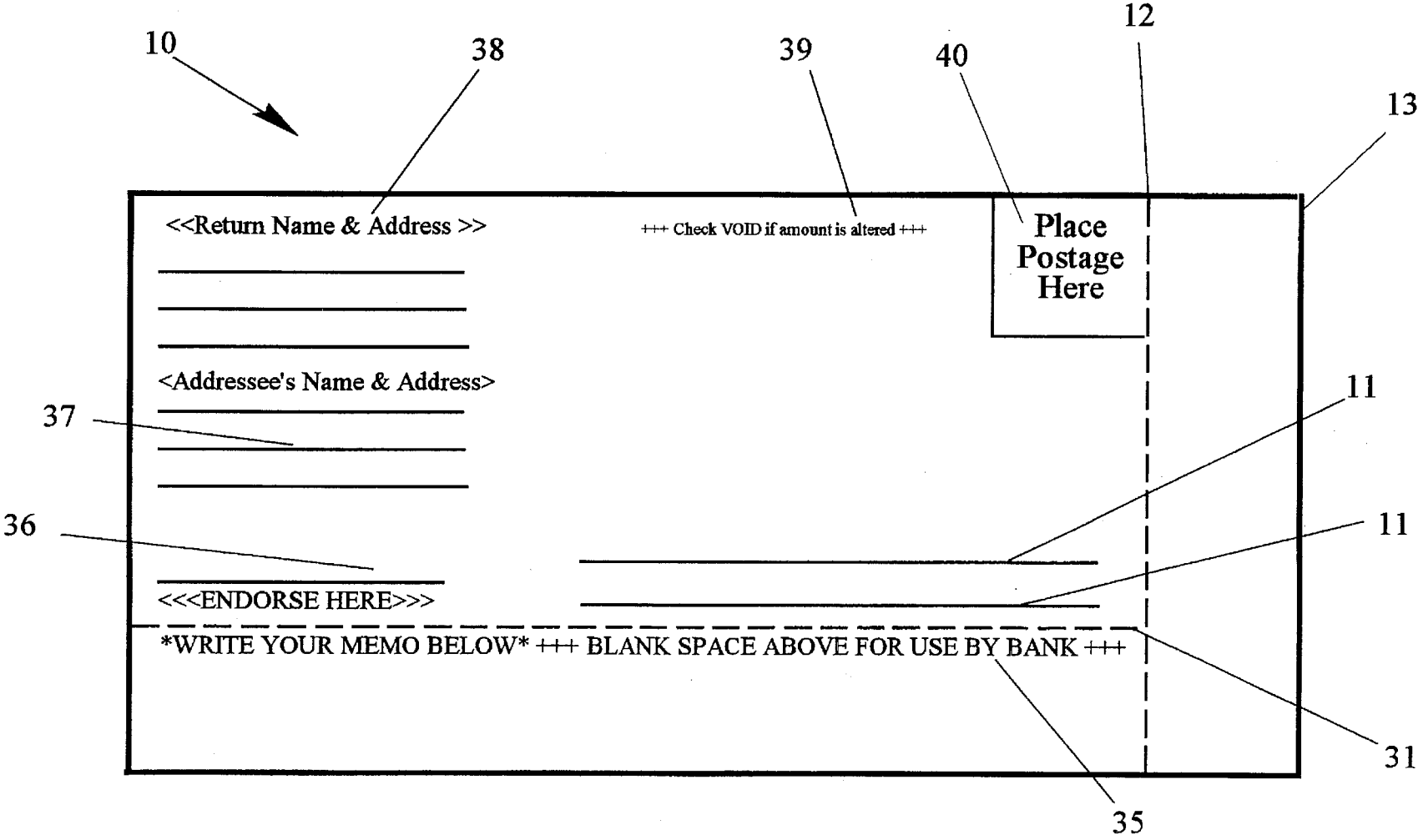
FIG. 15 is a bottom plan view of a non-negotiable postcard check before a safety strip is applied.

As shown in FIGS. 5 through 7, one end of the security strip 24 is folded into a "U" shape and placed through the slits 11 in such a way as to cover the magnetic ink imprinting 17 on the first side (front side) of the check 10, with concealment markings 34 visible from the front side and extending through the slits 11 to the bottom side with the concealing markings 34 over the imprinting 17. The adhesive end (second end) is then folded over to overlap the first end (concealment marking end), release liner 33 is removed, and the adhesive is then pasted onto the address side (second side) of the postcard check 10 and over the first end thereby securing both ends to the postcard check 10. Before the payee cashes or deposits the postcard check 10, the security strip 24 must be removed as instructed on the security strip 24. FIG. 8 shows the concealing markings 24 covering the area where the magnetic ink imprinting 17 is located.

On the check side (first side), or face of each postcard bank check 10, are printed the check number 25, the addressees name and address 41, instructions to the bank with regards to the addressee 43, the amount of the donation 22, the address of the financial institution 23 upon which the check is drawn and the account number 17, printed in machine readable language. Also included are the date of donation 42 and period of validity 18 of the check 10. A detachable stub 13, is provided for record keeping for tax or business purposes. A notice 19, limiting negotiability of the check is also provided. Instructions 20 are provided for removing the perforated tab 31 which is provided to expand the size of the postcard check 10 to a postcard size and reduce the size to a check size when removed.

A signature space 21 is provided for the donor's signature and the date of signature. The detachable stub 13 contains space for the donor to record the details of the check, a space for the donor to update account information after donation, and a perforated edge 12 for detaching stub 13.

On the reverse side of the post card check 10, is the notice 38, signifying space for the donor's name and address, a notice 39, to caution the donor not to omit name and address, space 37, for addressee's name and address, a space 36 for the addressee'e endorsement, and instructions 35, to the donor showing where to write a memo and where to leave blank for bank use.

FIG. 3 shows the face side of the post card check 10, with the slits 11 cut to insert a security strip 24, covering the account number 17 for security. The security strip 24 is described above.

At the right hand upper corner of the reverse side of post card check 10 is the position 40 for a Postcard stamp or a regular postal marking of a letter envelope or postcard for which a FIRST CLASS MAIL PERMIT has been granted with the statement "NO POSTAGE NECESSARY IF MAILED IN THE UNITED STATES" (not shown). Most charitable agencies suggest that the donor place the postage on the envelope to save needed charitable contributions. The stamp becomes a part of the contribution. In those cases where a forwarding envelope is provided, the postage would not be required.

The non-negotiable money-order post card checks 10 of the invention should be withdrawable only with the use of the recipient or receiving charity's bank checks. Unused non-negotiable post card checks 10 would be refundable. Should the holder decide not to use the post card checks 10, the issuing bank should refund the holder upon demand if these are surrendered before the expiration date. The post card checks 10 may be issued in booklets consisting of 5, 10 or 20 individual checks with face value of $1.00, $2.00, $5.00, or $10.00 for total values ranging from $5.00 to $200.0 per booklet.

Post card bank checks 10 may be sponsored by a recipient charity with the charity's name already printed as recipient, or unsponsored, therefore without the name of any particular charity. The non-negotiable post card checks 10 may be made available to the public through several channels. A first source may be a corporation organized independent of banks. A volume of checks 10 with a total agreed value may be sponsored by a charity. Such checks 10 are printed and sold for a sponsoring charity with the name and address of the charity printed on the address side of the individual checks 10. Non-sponsored or open checks 10 may also be printed and sold without the name and address of any particular charity. The corporation is responsible for cashing these checks 10 from the recipient charities through normal business transactions and the banking process.

Banks may also be suppliers of checks 10 through their normal check printers. The banks then sell these sponsored or non-sponsored checks 10 to the general banking public at the counters at such a price so as to cover its printing costs and profits, its banking services costs, and its business profits. The banks redeem these checks 10 from the recipient charities through the normal banking process.

Public charities and religious or non-profit organizations, e.g., United Charity, in connection with its annual fund raising campaign, may arrange with 100 name banks for each bank to issue 10,000 checks 10, each check having a face value of $2.00 for a total value of $2 million, with United Charity as the beneficiary. The 100 name banks then distribute these checks 10 to their respective branches to be displayed and sold at the counter to the general public at face value. United Charity supports the bank's selling campaign with advertisements in the media enticing the public to make its donations by using Checks 10 to make it convenient to the donors to send their donations. When the public buys these checks 10 from the issuing banks, the banks then deposit the proceeds under their checks 10 accounts. The public may then make its donations by mailing these checks 10 to United Charity. When United Charity receives these checks 10, it then turns these over to the respective issuing name banks for deposit under its accounts. The issuing name banks credit the money value of these donations to the accounts of the United Charity which can be withdrawn only by United Charity bank checks 10. The individual issuing banks then bill United Charity for their services on the basis of the amounts each has redeemed. The above example may be used as a business procedure to sell post card checks 10 to the various religious and non-profit organizations with the participation of a sponsoring financial institution.

As another example, the U.S. Postal Service may also sell checks 10 just as postage stamps are sold, in booklets with certain number of checks 10 in various denominations, or the way Postal Money Orders are sold to the public. The checks 10 are then redeemed in the usual way that Postal Money Orders are redeemed.

For non-sponsored checks 10, charity donors buy a booklet of checks 10 for the month or pay period when they deposit their pay checks at the banks choosing the desired denomination and the total number of checks 10 in a booklet. When the potential donors decide how much to donate to each charity, then they separate one of the checks 10 with the appropriate value, write the name and address of the charity, place a Post Card value stamp in the proper position on the reverse side of the check 10, and drop the check 10 in the mailbox.

For sponsored checks 10, the donors select and buy a booklet of checks 10 sponsored by their favorite charity with the desired denominations. When they receive a solicitation from their favorite charity they just have to tear off one check 10 and, if the appropriate postage is applied, drop the check 10 in the mailbox. The checks 10 are then processed in the ordinary course of business in the banking community.

Some minor changes and modifications may vary to meet present and future postal and bank security and other requirements, the invention is not considered limited to the specific examples chosen for the purposes of illustration, and includes all changes and modifications which do not constitute a departure form the true spirit and scope of this invention as claimed in the following claims and reasonable equivalents to the claimed elements.

What is claimed is:

1. A post card bank check security system for sending any reasonable amount of money by mail comprising:

a sheet of card stock having a face side and a reverse side and a first and second perforation means for separating portions of said card stock into a first, a second, and a third severable part, and a pair of slits, cut through said card stock at a prescribed location of a space allotted for printing of magnetic ink character encoding numbers, an image of a check printed on said face side of said first severable part, said image including a plurality of check information items, said check information items including, the check number, the addressee's name and address, instructions to bank with reference to addressee, the amount of the check, the address of the financial institution, the account number, the date of the check and period of validity of the check, a notice limiting negotiability of the check, payor's signature and date, a space for the payor to record details of a check, a strip of paper stock having a concealing end and an adhesive end, said strip being inserted within said pair of slits, wrapped over said account number on said face side and adhered to said reverse side to said concealing end and thereby creating a secure cover to conceal said account number during processing through the postal system, an image of a post card printed on said reverse side of said first severable part of said post card, said image including a notice signifying space for payor's name and address, a note to caution payor, a space for addressee's name and address, and a space for addressee's endorsement, an image of a check record printed on said face side of said second severable part, including a space for payor to record details of the check, and a space for updating account information, an image of instructions printed on said face side of said third severable part including instructions for removing said third severable part, and a notice pertaining to negotiability of the check, and, an image of instructions printed on said reverse side of said third severable part including instructions to payor for using said reverse side.

2. A postcard bank check security system for sending an amount of money by mail said security system comprising:

a sheet of card stock having a face side and a reverse side, an image of a check printed on said face side, said image including a plurality of check information items, said check information items including an account number printed in magnetic ink character encoding numbers, the check number, the addressee's name and address, instructions to bank with reference to addresses, the amount of the check, the address of the financial institution, the date of the check and period of validity of the check, a notice limiting negotiability of the check, payor's signature and date and a space for the payor to record details of a check, an image of a post card printed on said reverse side, a pair of slits cut through said card stock located just on top and just below said account number and extending the length of said account number, and a strip of paper having a concealing end and an adhesive end, said strip being inserted within said pair of slits, wrapped over said account number on said face side and adhered to said reverse side to said concealing end and thereby creating a secure cover to conceal said account number during processing through the postal system.

* * * * *